US008125404B2

(12) United States Patent
Chen et al.

(10) Patent No.: US 8,125,404 B2
(45) Date of Patent: Feb. 28, 2012

(54) MONOPOLE ANTENNA WITH HIGH GAIN AND WIDE BANDWIDTH

(75) Inventors: Shang-Jen Chen, Tu-cheng (TW); Lung-Sheng Tai, Tu-cheng (TW); Chun-Ming Chiu, Tu-cheng (TW); Shu-Yean Wang, Tu-cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 325 days.

(21) Appl. No.: 12/386,623

(22) Filed: Apr. 21, 2009

(65) Prior Publication Data

US 2009/0262040 A1 Oct. 22, 2009

(30) Foreign Application Priority Data

Apr. 21, 2008 (TW) ..... 97114428 A

(51) Int. Cl.
*H01Q 1/36* (2006.01)

(52) U.S. Cl. ..... 343/895; 343/700 MS; 343/850

(58) Field of Classification Search ..... 343/700 MS, 343/850, 860, 864, 895
See application file for complete search history.

(56) References Cited

U.S. PATENT DOCUMENTS

| | | | | |
|---|---|---|---|---|
| 5,374,937 | A * | 12/1994 | Tsunekawa et al. | 343/702 |
| 5,412,392 | A * | 5/1995 | Tsunekawa | 343/702 |
| 7,262,739 | B2 * | 8/2007 | Chen | 343/725 |
| 7,659,793 | B2 * | 2/2010 | Fukushima | 333/17.1 |
| 2008/0062054 | A1 * | 3/2008 | Ke et al. | 343/730 |

FOREIGN PATENT DOCUMENTS

| | | |
|---|---|---|
| TW | 560706 | 1/2003 |
| TW | 1276251 | 1/2006 |

* cited by examiner

*Primary Examiner* — Jacob Y Choi
*Assistant Examiner* — Shawn Buchanan
(74) *Attorney, Agent, or Firm* — Wei Te Chung; Andrew C. Cheng; Ming Chieh Chang

(57) ABSTRACT

A monopole antenna includes a base board having a first side and a second side, a grounding element attached on the first side of the base board, a coupling element attached on the first side of the base board and being spaced apart from the grounding element, and a radiating element connected to the coupling element and exposed out the base board.

8 Claims, 5 Drawing Sheets

MONOPOLE ANTENNA WITH HIGH GAIN AND WIDE BANDWIDTH

BACKGROUND OF THE INVENTION

1. Field of the Invention

The present invention relates generally to a monopole antenna, and more particularly to a monopole antenna with a spiral structural benefited with increased gain.

2. Description of the Prior Art

Wireless communication devices, such as cellular phones, notebook computers, electronic appliances, and the like, are normally equipped with an antenna that serves as a medium for transmission and reception of electromagnetic signals, such as date, audio, image, and so on. The antenna can be built outside or inside of the devices. Usually, an external antenna is not easily interfered by inner components of the electrical device and can be easily adjusted by user for achieving desired operating performance. Either a monopole antenna or a dipole antenna is a kind of traditional external antenna. The length of a radiating element of a traditional monopole antenna substantially equals to ½ wavelength (λ). While, when used in long distance transmission/reception, general monopole antenna generally has weak gain and undesired operating performance.

Taiwanese Patent No. 560706, issued to Chen on Nov. 1, 2003, disclosed a hybrid antenna comprising a dipole antenna, a helical antenna, and a rod antenna all of which connect to one another in series. The complex antenna improves the gain of the antenna and the communication distance of the antenna is fairly increased. However, the connection area between the dipole antenna and the inner conductor of the feeding line does not have any additional protection. Thus, not only will the connecting area be easily broken, but will also be easily oxidized. Taiwanese Patent No. I276251, issued to Wong et al. on Feb. 1, 2006, discloses a monopole antenna attached on a printed circuit board and having high gain. However, the monopole antenna failed to work in a wide bandwith.

Hence, in this art, a monopole antenna to overcome the above-mentioned disadvantages of the prior art should be provided.

BRIEF SUMMARY OF THE INVENTION

A primary object, therefore, of the present invention is to provide a monopole antenna having high gain, wide bandwidth and while with compact size.

In order to implement the above object, the monopole antenna made in accordance with the present invention comprises a base board having a first side and a second side, a grounding element attached on the first side of the base board, a coupling element attached on the first side of the base board and being spaced apart from the grounding element and a radiating element connected to the coupling element and exposed out the base board.

Other objects, advantages and novel features of the invention will become more apparent from the following detailed description of a preferred embodiment when taken in conjunction with the accompanying drawings.

DETAILED DESCRIPTION OF THE INVENTION

Figure 1:
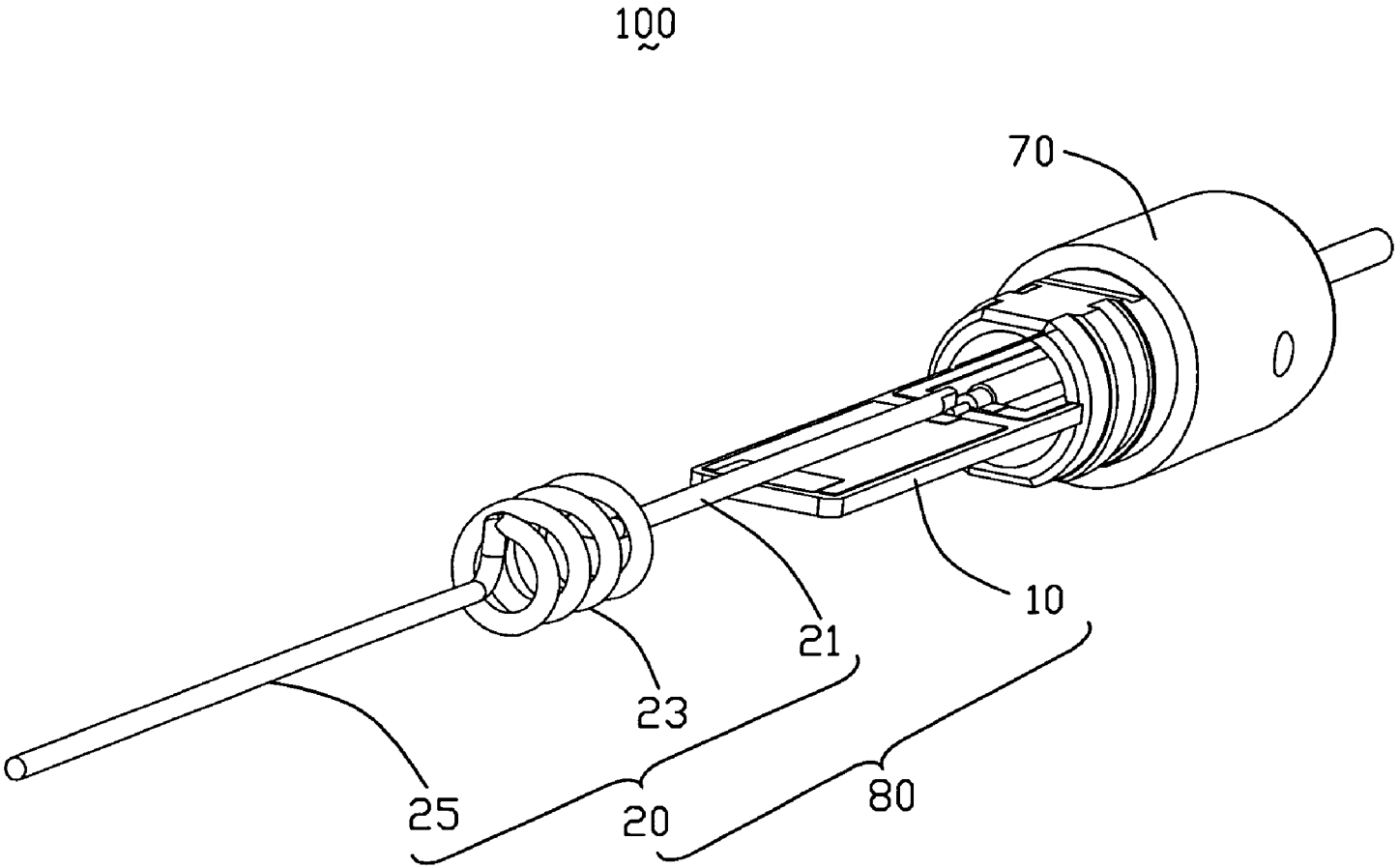
FIG. 1 is a perspective view illustrating a preferred embodiment of a monopole antenna in according with the present invention.
Figure 2:
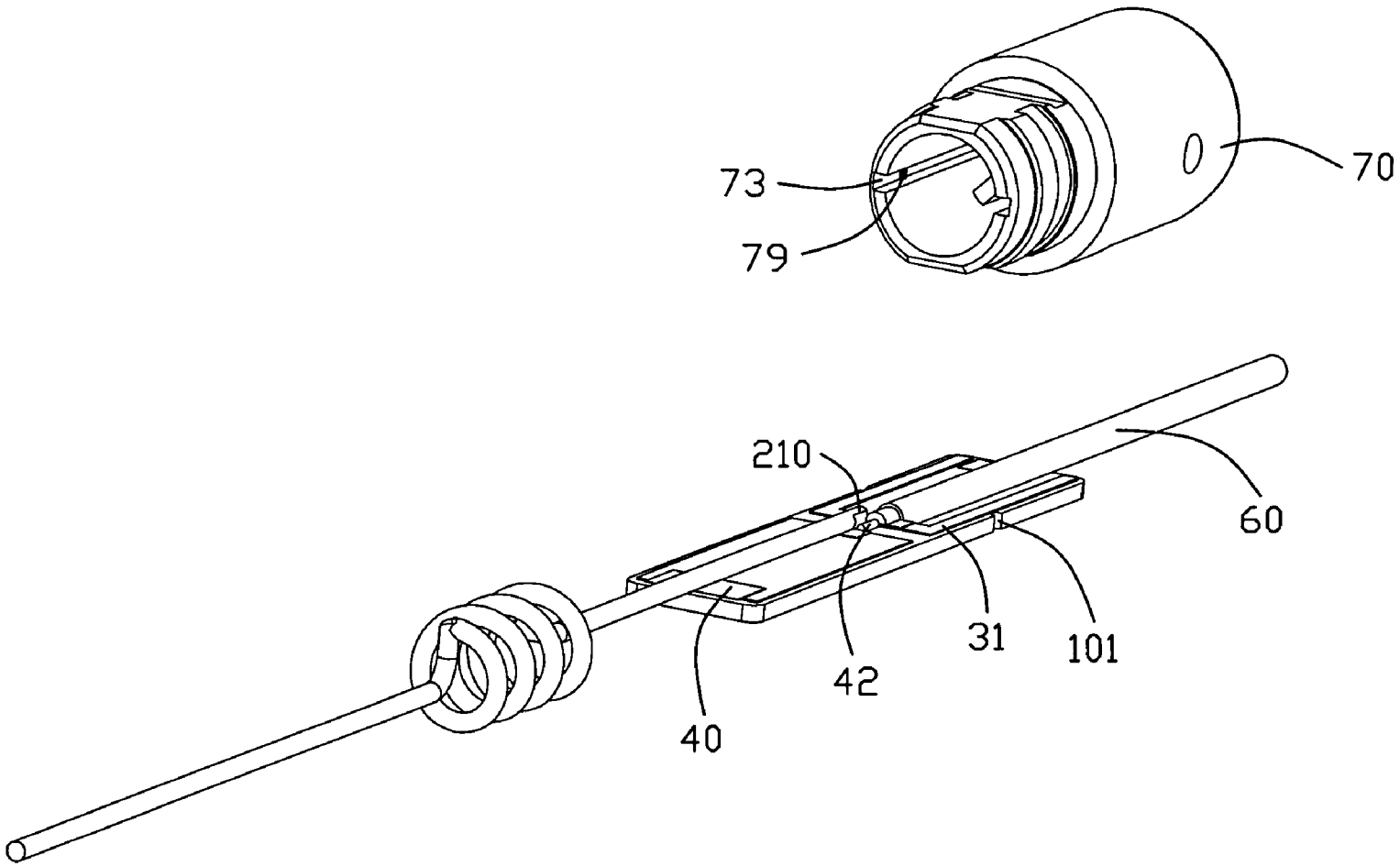
FIG. 2 is a partly exploded, perspective view of FIG. 1.
Figure 3:
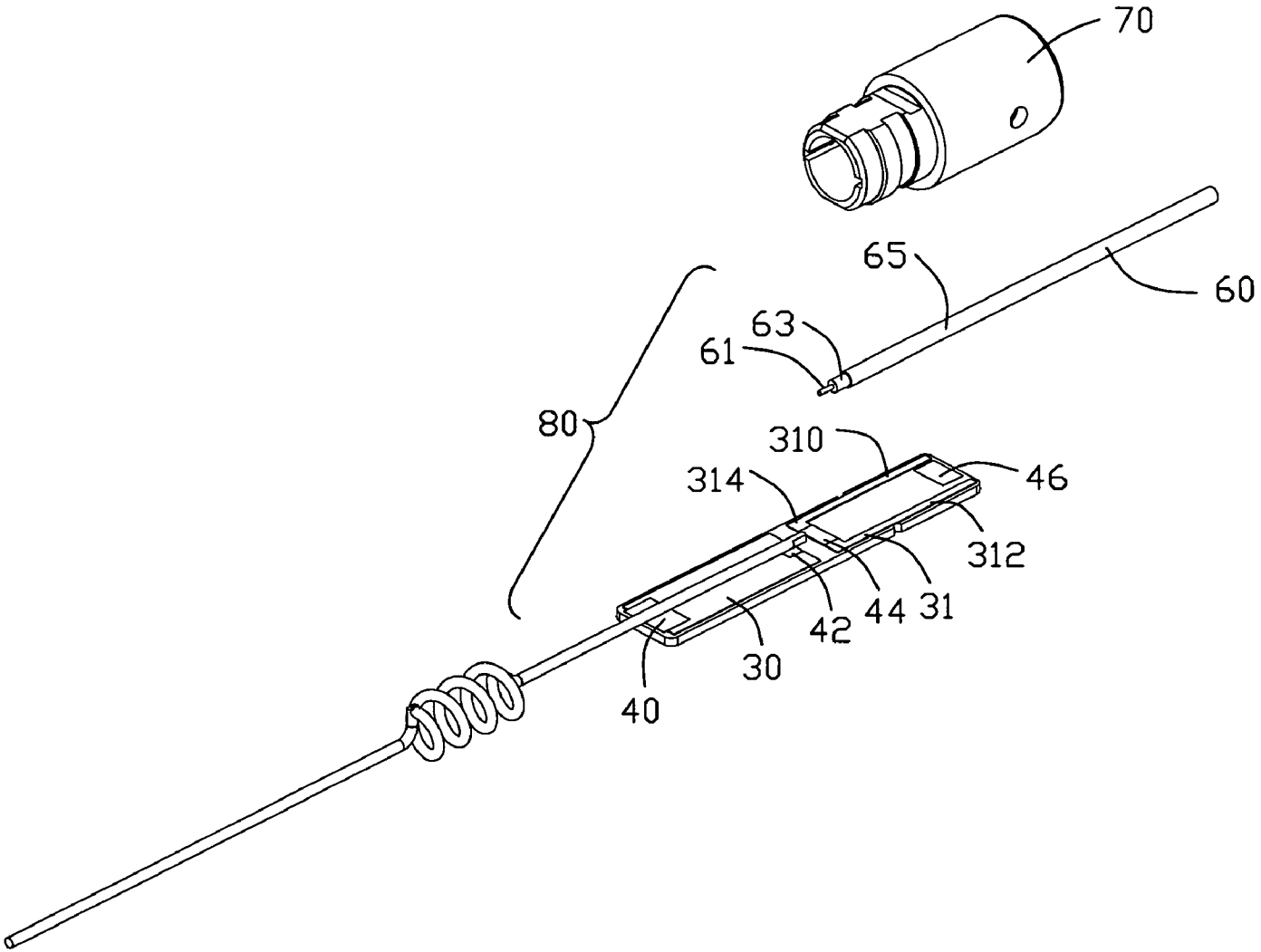
FIG. 3 is an exploded view of FIG. 1.
Figure 4:
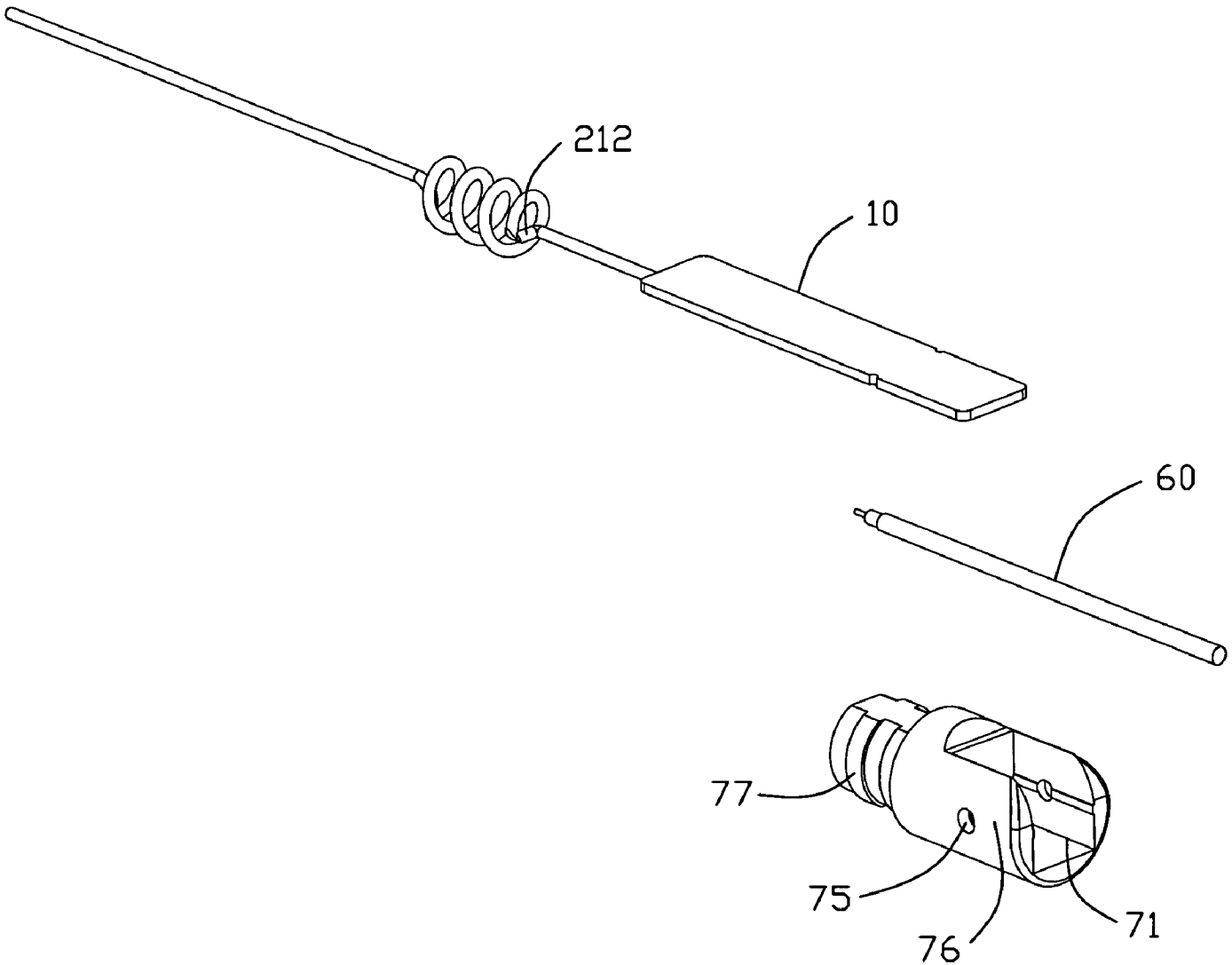
FIG. 4 is an exploded view similar to FIG. 3, but viewed from another angle.

Reference will now be made in detail to a preferred embodiment of the present invention.

Reference to FIGS. 1 to 4, a monopole antenna assembly made in according with a preferred embodiment of the present invention is shown. The monopole antenna assembly 100 is intended for being attached to an electric device, such as access points (AP), mobile phones, notebooks et al., and extending out the electric device for transmitting wireless signals. The monopole antenna assembly 100 comprises a monopole antenna 80 and a fastening element 70 for securely fixing the monopole antenna 80 on the electrical device.

The monopole antenna 80 includes a base board 10, a radiating element 20, a grounding element 31 attached on the base board 10 and separated from the radiating element 20, a coupling element 30 attached on the base board 10 and electrically connected to the radiating element 20, and a feeding line 60.

The radiating element 20 includes a straight first radiating portion 21 with a first end 210 and a second end 212, a spiral second radiating portion 23 extending from the second end 212 of the first radiating portion 21, and a straight second radiating portion 25 extending from the second radiating portion 23. The first radiating portion 21 and the third radiating portion 25 are respectively connected to the two opposite ends of the second radiating portion 23.

The coupling element 30 and the grounding element 31 are respectively arranged on the base board 10 and the coupling element 30 is spaced apart from the grounding element 31. The coupling element 30 is substantially equal to a quarter of λ of the monopole antenna's working frequency and includes a first fixing portion 40 and a second fixing portion 42 respectively arranged on the two ends of the coupling element 30. The radiating element 20 is electrically connected to the coupling element 30 by the first radiating portion 21 being attached on the first and second fixing portions 40, 42 of the coupling element 30. The first end 210 of the first radiating portion is connected to the first fixing portion 40 and the middle of the first radiating portion 21 connected to the second fixing portions 42.

The grounding element 31 is substantially of U-shaped and includes a first side arm 310, a second side arm 314 and a connecting arm 312 connecting the first side arm 310 and the second side arm 314. The length of both the first arm 310 and the second side arm 314 is substantially equal to a quarter of λ. A grounding point 44 is substantially defined on the middle of the connecting arm 312. The grounding element 31 is attached on the base board 10 with the connecting arm 312 being attached on the middle of the base board 10 and the first side arm 310 and the second side arm 314 respectively extending along the two sides of the base board 10. In this preferred embodiment, the base board 10, the grounding element 31, and the coupling element 40 are formed by a printed circuit board. While in other alternative embodiments, the grounding element 31 and the coupling element 40 can be made from a metal patch and be plastered on the insulative base board 10.

The feeding line 60 has an inner conductor 61 soldered to the fixing portion 42 of the coupling element 30, an outer conductor 63 soldered to the connecting arm 314 of the grounding element 31 on the grounding point 44, and an outer insulative stratum 65 cover the outer conductor 63. The base board 10 has a third fixing portion 46 on one end thereof opposite to the first fixing portion 40 and the outer insulative stratum 65 of the feeding line 60 is attached on the third fixing portion 46 for securely fixing the feeding line 60 on the base board 10. In this embodiment, the inner conductor 61, the first end 210 of the first radiating portion 21, and the outer conductor 62 are further securely fixed on their corresponding fixing portions 40, 42, 46 by glue.

The fastening element 70 is substantially of cylindrical shape and the base board 10 is inserted into the fastening element 70 for being fixed in the fastening element 70. The fastening element 70 includes a receiving slot 73 and a pair of pins 79 respectively arranged in the two sides of the receiving slot 73. The base board 10 includes a pair of gaps 101 respectively arranged on the two sides thereof and corresponding to the pins 79 in the receiving slot 73, so as to the base board 10 is received in the fastening element 70 along the receiving slot 73 and the pins 79 are inserted into the gaps 101. The fastening element 70 fixes the monopole antenna 80 and can be assembled on the electrical device.

Figure 5:
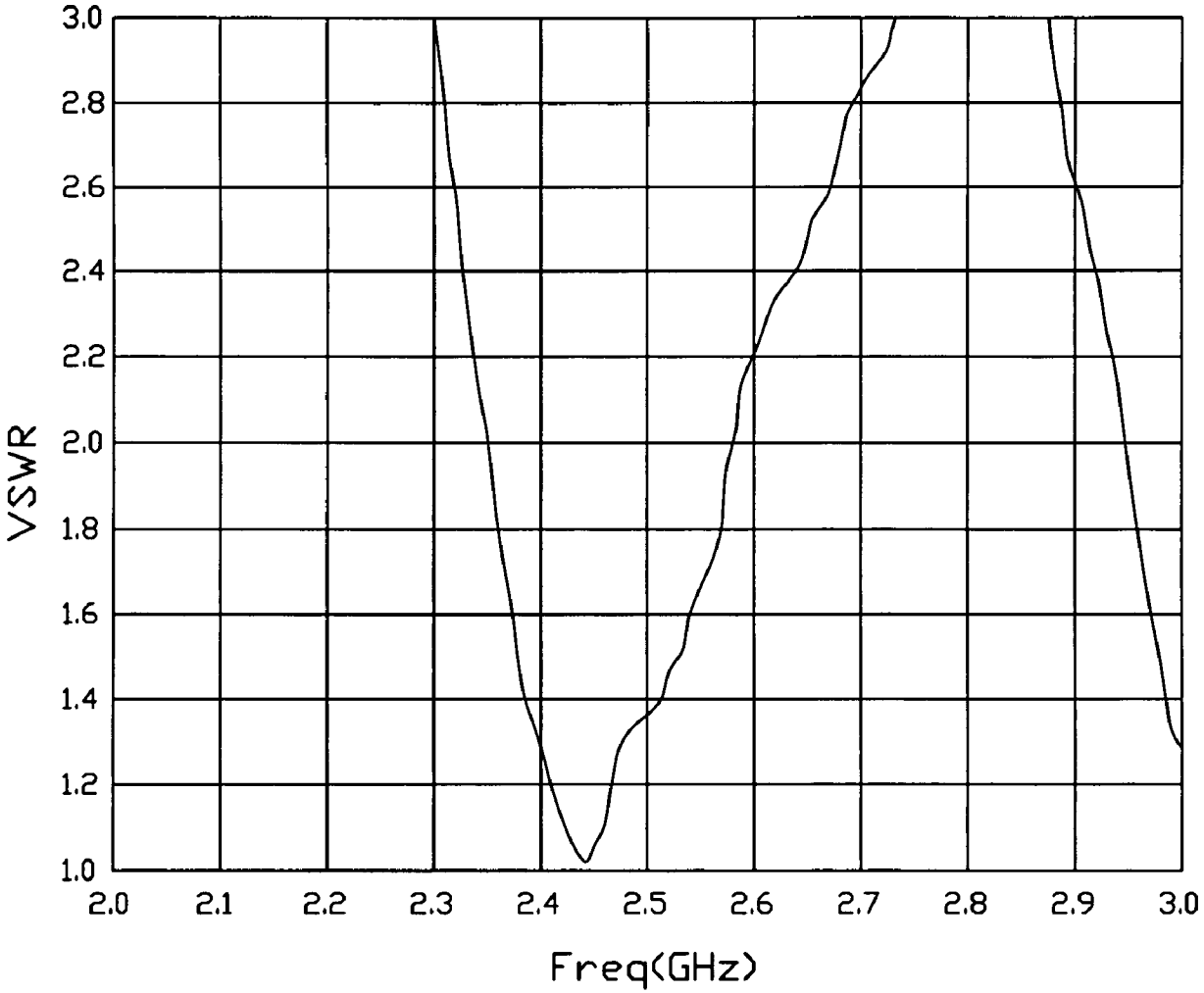
FIG. 5 is a test chart recording for the monopole antenna of FIG. 1, showing Voltage Standing Wave Ratio (VSWR) as a function of WLAN frequency.

In this embodiment, the distance between the coupling element 40 and the grounding element 30 is equal to 2 mm and the coupling element 40 is used to match the impedance of the monopole antenna 80 to the feeding impedance. Thus, reference to FIG. 5, the monopole antenna 80 works at 2.35-2.58 GHz frequency band, and has a bandwidth over 200 MHz.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A monopole antenna, comprising: a base board, having a first side and a second side; a grounding element, attached on the first side of the base board; a coupling element, attached on the first side of the base board and being spaced apart from the grounding element; and a radiating element, connected to the coupling element and exposed out the base board, said radiating element comprising a straight first radiating portion, a spiral second radiating portion, and a straight third radiating portion, said first radiating portion and said third radiating portion are connected to two opposite ends of the second radiating portion; wherein said grounding element and the coupling element arranged in a line and the first radiating portion crosses through the entirety of the coupling element; wherein said first radiating portion of the radiating element is attached on the coupling element, the second radiating portion and the third radiating portion are spaced apart from the coupling element.

2. The monopole antenna as claimed in claim 1, wherein said coupling element is substantially of rectangular configuration and comprises a first fixing portion and a second fixing portion, said first radiating portion is attached to the coupling element on the first and second fixing portions.

3. The monopole antenna as claimed in claim 2, wherein said coupling element has a length equal to a quarter of $\lambda$ of the working frequency of the monopole antenna.

4. The monopole antenna as claimed in claim 2, wherein said grounding element is substantially of U-shaped configuration and comprises a first side arm, a second side arm and a connecting arm connecting the first side arm and the second side arm.

5. The monopole antenna as claimed in claim 4, wherein said length of both the first arm and the second arm is substantially equal to a quarter of $\lambda$ of the working frequency of the monopole antenna.

6. The monopole antenna as claimed in claim 2, wherein said monopole antenna further comprises a feeding line having an inner conductor connected to the coupling element and an outer conductor connected to the grounding element.

7. The monopole antenna as claimed in claim 6, wherein said inner conductor of the feeding line is connected to the second fixing portion of the coupling element.

8. The monopole antenna as claimed in claim 1, wherein said monopole antenna comprises a feeding line, said feeding line comprises an inner conductor connected to the connecting element and an outer conductor connected to the grounding element.

* * * * *